US007188743B1

(12) United States Patent
Gates et al.

(10) Patent No.: US 7,188,743 B1
(45) Date of Patent: Mar. 13, 2007

(54) AERATING GLASS & METHOD

(76) Inventors: David Alan Gates, 117 Robin St., Napa, CA (US) 94558; Dominic Michael Gates, 117 Robin St., Napa, CA (US) 94558; Christina Kennedy Gates, 117 Robin St., Napa, CA (US) 94558

( * ) Notice: Subject to any disclaimer, the term of this patent is extended or adjusted under 35 U.S.C. 154(b) by 268 days.

(21) Appl. No.: 10/610,782

(22) Filed: Jul. 1, 2003

(51) Int. Cl.
*A47G 19/22* (2006.01)

(52) U.S. Cl. ..... 215/389; 220/710

(58) Field of Classification Search ..... 220/710; 215/389
See application file for complete search history.

(56) References Cited

U.S. PATENT DOCUMENTS 1,031,950 A * 7/1912 Miller ..... 215/374
2,885,134 A * 5/1959 Cohen ..... 229/400
4,428,490 A * 1/1984 Holloway ..... 215/374
4,953,725 A * 9/1990 Gil Buj ..... 215/389

* cited by examiner

*Primary Examiner*—Stephen J. Castellano
(74) *Attorney, Agent, or Firm*—Risto A. Rinne, Jr.

(57) ABSTRACT

An apparatus for the aeration of a fluid prior to its consumption includes a container that is adapted to house a quantity of the fluid. A bottom end of a conduit that is open at both ends is attached to the container and is disposed in the fluid. A second opposite upper end of the conduit is disposed above the bottom end and is placed in the mouth of a user. Fluid is drawn up through the conduit by the creation of a partial vacuum when the user sucks on the upper, drinking end. An air infusion opening is provided in the conduit near the upper end above a normal maximum fluid elevation level. The infusion opening allows for ambient air to simultaneously enter into a fluid stream that is being drawn up through the conduit, thereby aerating the fluid prior to its entry into the mouth. If the fluid is especially hot, the ambient air also helps to cool the fluid.

20 Claims, 2 Drawing Sheets

AERATING GLASS & METHOD

RELATED APPLICATION

This application is related to an application filed by the same inventors on Jul. 25, 2002 entitled "Wine Tasting Straw" Ser. No. 10/206,487.

BACKGROUND OF THE INVENTION

1. Field of the Invention

The present invention, in general relates to drinking vessels (i.e., glasses) and, more particularly, to devices that aerate a beverage prior to its consumption and which may also cool the beverage.

It is important to aerate a beverage for many reasons. In particular, wines benefit from aeration prior to an analysis of their qualities. This is discussed in greater detail below. Other beverages, whether served at room temperature, cooled, or heated may similarly benefit from aeration.

It is also desirable to cool a hot beverage prior to its consumption. Those who have burnt their lips on tea or coffee that was too hot are well aware of this need. Other than putting something cold in a hot beverage to cool it, the only other solution is to wait.

The comparison of wines is an important determination to wine producers. Accordingly, wine tasters, that is people with an especially acute awareness of wine qualities, judge the attributes of many different wines. Reports in magazines, articles in various publications, and even more important, the awarding of ribbons and ranking of wines is influential in determining the sales and price of various vintage wines as well as the renown of the wine producers.

It is also important to the wine tasters themselves to be optimally able to accurately determine the subtle differences that occur between the various wines if their opinion is to be well regarded. These subtle differences include complexities and flaws that the average person is unaware of.

Currently, wine tasters use a glass to swirl the wine and sample its aroma. A sip is followed by sucking air into the mouth through pursed lips in what is commonly known as a "reverse whistle". The mixing of the wine with air is also sometimes referred to as "volatizing the esters", which is a more technical term of the process.

The reverse whistle aerates the wine and it is the infusion of air that helps to reveal the wine's various complexities and also its flaws, especially the more subtle ones.

However, after thus having sampled a few different wines, the ability to differentiate naturally diminishes. Wine tasters currently cleanse the palette by either sipping water or by consuming crackers or bread between the various samplings. The more wine that is consumed the more difficult cleansing of the palette becomes. Therefore, it is clearly desirable to limit the quantity of wine that is required to be consumed so that cleansing of the palette is easier and more effective.

While it is not generally regarded as an issue, wine does include alcohol and it is conceivable also that it is desirable to reduce the quantity of alcohol (i.e., wine) that is consumed so as to ensure that the perception of the wine taster is not substantially affected by a potential increase in the blood alcohol content level.

However, aside from the quantity that is consumed there is another problem inherent in the above approach. Before aeration can occur the wine taster first must take a sip. Then the reverse whistle procedure is used to aerate the wine, as was described hereinabove.

The problem is that the reverse whistle is no longer able to aerate a pure, undistorted and undiluted sample of the wine. This is because the wine has already mixed with the saliva in the wine taster's mouth.

The saliva affects the acidity (i.e., the pH) of the wine and accordingly, the character of the wine itself is altered before it is ever critiqued. The wine taster is discerning not the essence of the pure, original wine, but to some extent, how that particular wine reacts with the chemistry of his own saliva. This can vary from taster to taster, only increasing the subjectivity of any test result.

When the taster is looking for the most subtle of differences for a great many wine attributes, this becomes a significant obstacle. The wine is also diluted to some extent by the saliva prior to aeration and subsequent analysis. Analyzing an aerated but diluted wine sample is certainly not an optimum condition, yet this is all that the industry has had to rely upon thus far.

It is desirable to provide a device and method for tasting wines that is easy to use and inexpensive to manufacture and sell. This would permit amateur wine tasters to practice their art and improve their own ability to discern the various wines apart from each other.

A problem related to wine tasting is that sediments tend to accumulate at the bottom of a glass of wine. This concentration of sedimentation is to be avoided during tasting of the wine.

There is a further need also and that is for aesthetics. Wine tasting is regarded much as an art form, and those who scrutinize wines regard themselves as experts in the field, artists skilled in the art of discerning subtle nuances of taste, hue, complexion, aftertaste, etc. Any device relied upon must be aesthetically appealing to the wine taster, as well as functional.

Accordingly, there exists today a need for an aerating glass and method that infuses or mixes air with a beverage before intake into the mouth. It is also desirable to be able to cool a hot beverage prior to intake.

Clearly, an apparatus and method that provides an aerated sample of a beverage would be useful and desirable.

2. Description of Prior Art

Glasses with a straw attached are generally, known. While the structural appearance of the previously described device, at first appearance, may have similarities with the present invention, it differs in material respects. These differences, which will be described in more detail hereinafter, are essential for the effective use of the invention and which admit of the advantages that are not available with the prior known device.

OBJECTS AND SUMMARY OF THE INVENTION

It is an object of the present invention to provide an aerating glass that is inexpensive to manufacture.

It is also an important object of the invention to provide an aerating glass that is adapted to aerate a beverage.

Another object of the invention is to provide an aerating glass that is adapted to cool a beverage.

Still another object of the invention is to provide an aerating glass that is adapted to aerate a beverage prior to the beverage substantially contacting a quantity of saliva in a mouth of a user.

Still yet another object of the invention is to provide an aerating glass that is adapted to lessen a quantity of beverage that is required for critiquing by a person skilled in the art of tasting such beverages.

Still one substantially important object of the invention is to provide an aerating glass that includes a conduit attached thereto for drawing a fluid through the conduit and including an opening in the conduit above a normal level of a beverage for the infusion of ambient air into the beverage.

Still yet another important object of the invention is to provide an aerating glass that automatically infuses air into the fluid stream as a beverage is sucked through a conduit portion of the glass.

Still yet another important object of the invention is to provide an aerating glass that does not draw sediments that have accumulated at the bottom of a container into an intake fluid stream.

A still further important object of the invention is to provide a method of infusing air into a fluid stream as a fluid is being sucked through a conduit.

One still further desirable object is to provide an aerating glass that is enjoyable (i.e., fun) to use.

One yet still further desirable object is to provide an aerating glass that is adapted for either right or left hand use.

Briefly, an aerating glass that is constructed in accordance with the principles of the present invention has a container (i.e., a vessel) that is adapted to house a quantity of fluid with a lower opening end of a conduit attached thereto. The conduit's lower opening end is disposed in the fluid and is preferably elevated above a bottom of the container. A second opposite drinking end of the conduit is disposed above the lower opening end and is placed in the mouth of a user. Fluid is drawn up through the conduit by the creation of a partial vacuum when the user sucks on the drinking end. An air infusion opening is provided in the conduit near the opposite end above a normal maximum fluid elevation level. The infusion opening allows for ambient air to simultaneously enter into the fluid stream that is being drawn up through the conduit, thereby aerating the fluid prior to its entry into the mouth. If the fluid is especially hot, the ambient air also helps to cool the fluid.

DETAILED DESCRIPTION OF THE INVENTION

Figure 1:
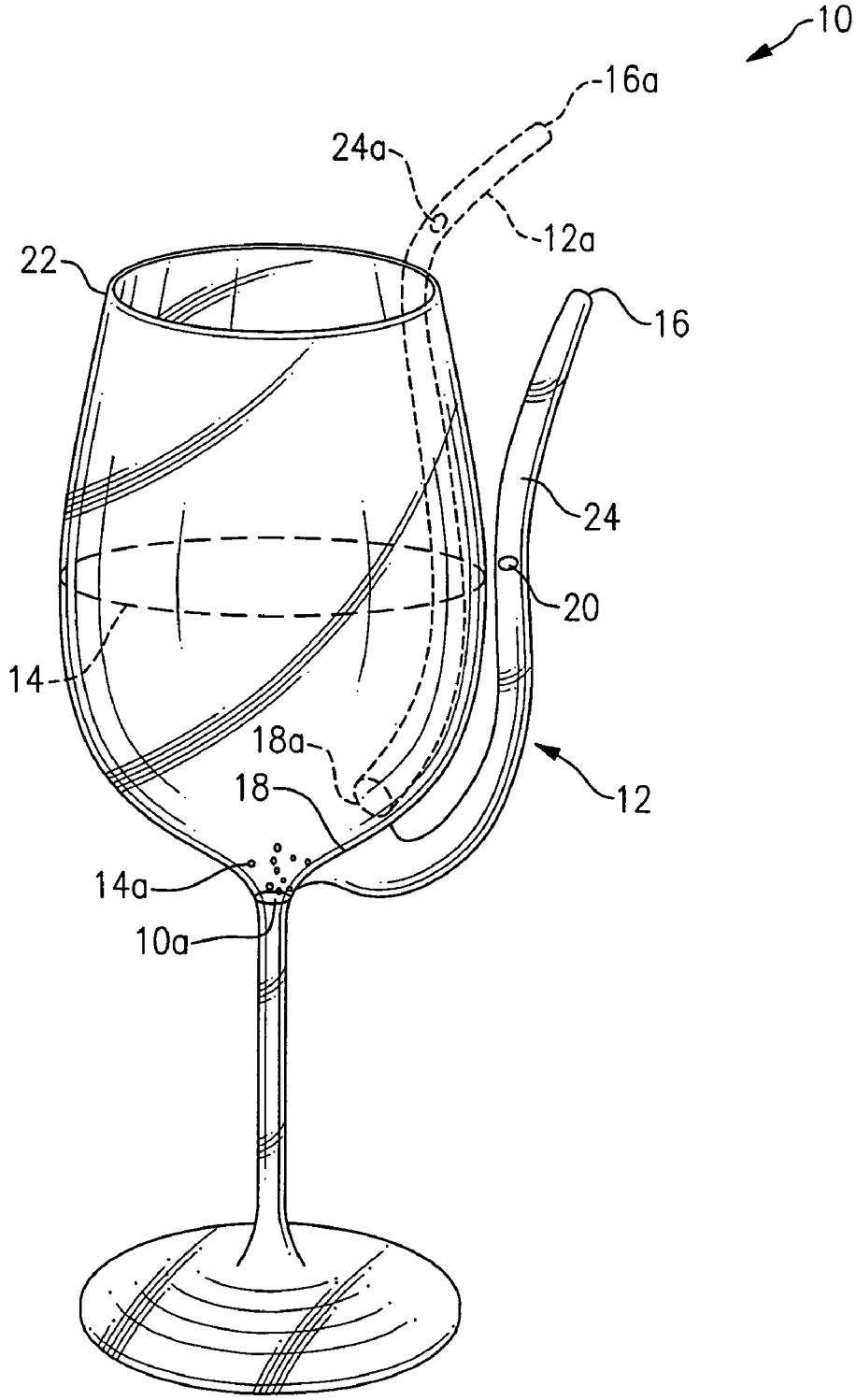
FIG. 1 is a view in perspective of an aerating glass used for wine.

Referring to all of the drawings and in particular now to FIG. 1 is shown, an aerating glass, identified in general by the reference numeral 10.

The aerating glass 10 includes a stemware as is commonly used for drinking wine. Various types of glasses other than stemware are also suitable for use.

A conduit, identified in general by the reference numeral 12, is attached near a bottom 10*a* of the vessel portion of the glass 10.

If a wine 14 (dashed lines) includes sediments 14*a*, they will fall to the bottom 10*a* of the glass 10 and not typically be drawn up through the conduit 12, as is described hereinafter.

The conduit 12 includes an upper drinking end 16 that is placed in a mouth of a user (not shown). The user wraps his or her lips around the drinking end 16 and by sucking, creates a partial vacuum that draws fluid up and out of a bottom opening 18 of the conduit 12. The bottom opening 18 is open (i.e., accessible) to the wine 14 on the inside of the glass 10. The upper end 16 is disposed at a higher elevation than is the bottom opening 18.

Accordingly, the wine 14 by force of gravity alone, flows into the conduit 12 through the bottom opening 18 until it reaches a level 20 in the conduit 12 that is the same as in the glass 10.

If the user wishes to use the glass 12 in a conventional manner, he or she would sip from a side 22 that is opposite (or even adjacent) that where the conduit 12 is disposed.

If the user wishes to use the aerating glass 10 as optimally intended, the wine 14 is sucked in through the upper drinking end 16 and into the mouth.

A smaller infusion opening 24 is provided in the conduit 12 at an elevation that is above that of the wine 14. The infusion opening is small, so as not to destroy the partial vacuum that is created during sucking and thereby prevent the drawing of the wine 14 up through the conduit 12. For most applications, the infusion opening 24 will not exceed one-sixteenth of an inch in diameter.

As the wine 14 is being drawn up through the conduit 12, ambient air is simultaneously drawn in through the infusion opening 24 where it mixes with the wine 14 stream passing up through the conduit 12 thereby aerating the wine 14 prior to its entry into the mouth. The infusion opening 24 allows for the infusion, or entry, of ambient air into the fluid stream that is passing up the conduit 12.

Accordingly, the objectives described hereinbefore that appertain to aerating a fluid prior to its entry into the mouth are accomplished.

Accordingly, a device and method for aerating a fluid (i.e., the wine 14) is provided. It is noted that for this example the conduit 12 is disposed on an outside (i.e., exterior) of the vessel portion of the glass 12. If desired, the conduit 12 is further strengthened by attachment at a midpoint (i.e., near the level 20) to an exterior of the glass 10 by any preferred method, for example, welding, extrusion, adhesive, etc.

According to a modification, a modified conduit 12*a* is provided on an inside of the vessel portion of the glass 10, the modified conduit 12*a* is shown in dashed lines. The modified conduit 12*a* is similarly attached where desired to the inside of the glass 10 and includes a modified bottom opening 18*a* that is preferably disposed above the bottom of the glass 10 (to prevent sediment from entering).

The modified conduit 12*a* extends above the glass 10 and includes a modified infusion opening 24*a* that is also disposed above a normal maximum fluid level and a modified drinking opening 16*a* that is disposed above the modified infusion opening 24*a*.

Accordingly, the modified conduit 12*a* teaches a modification whereby use of the invention occurs with the fluid (i.e., the wine 14) being drawn up from inside of the glass 10 and then, after passing over an upper lip of the glass 10, continues upward and away from the glass 10 in the modified conduit 12*a*.

The glass 10 can of course include any type of a vessel intended to hold a fluid. This may include other modified types of stemware as well as more conventional cylindrical types of glasses, including mugs. The fluid can be anything that is to be consumed, for example, any alcoholic or non-alcoholic beverage. For most beverages, the taste is enhanced by such aeration techniques. Even beverages as common as milk, flavored milk, coffees, teas, and carbonated beverages can benefit from such an aeration.

The glass 10 helps each user to better appreciate the finer nuances of flavor in whatever beverage they are consuming. It also slows the process of drinking down and focuses the user's attention on the taste of the beverage, all of which add to the enjoyment (i.e., fun) of drinking.

As mentioned hereinabove, drinking also becomes especially enjoyable. A youth might especially enjoy the experience of drinking milk through the glass 10. If one listens carefully, one may hear the aeration taking place. The aerated beverage has a different feel and to the youth, it might appear as if he or she is drinking a pseudo "carbonated type of milk".

As was mentioned hereinabove, the bottom opening 18 and the modified bottom opening 18*a* are preferably disposed above any of the sediment 14*a* in the wine 14. If the wine 14 is slowly drawn up through the conduit 12, it is not likely that much, if any, of the sediment 14*a* will be consumed. In general, when tasting the wine 14, the sediment 14*a* is prone to distort the finer attributes that the wine 14 possesses.

Figure 2:
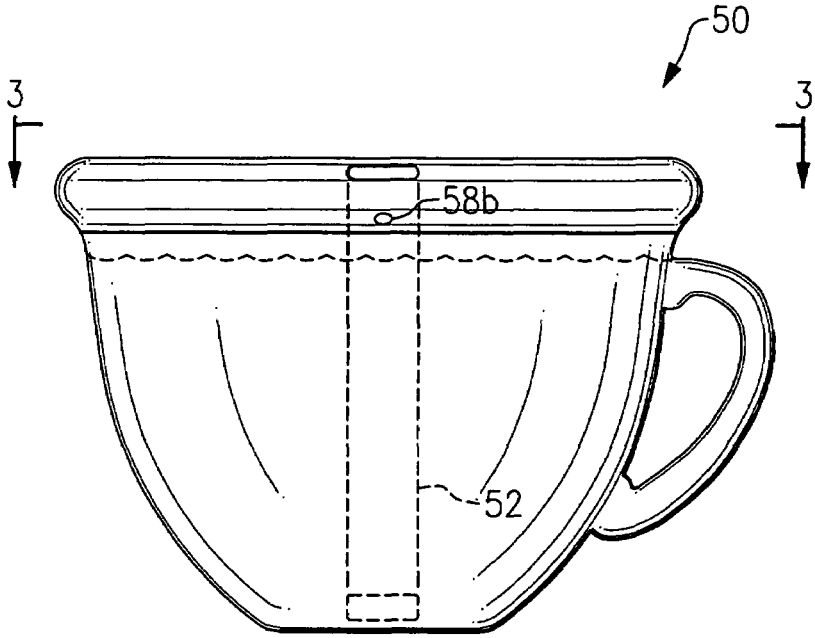
FIG. 2 is a side view of an aerating glass commonly used for a hot beverage, such as tea.
Figure 3:
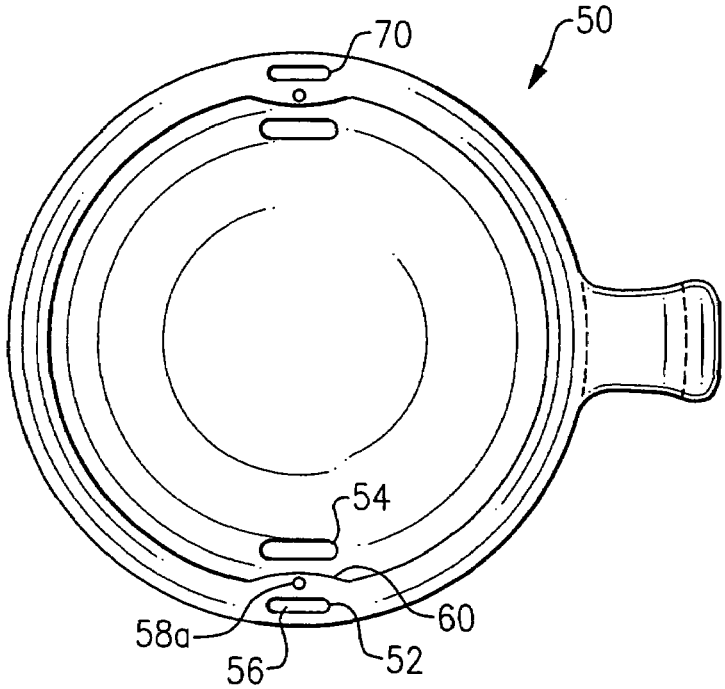
FIG. 3 is a top view taken along the line 3—3 of FIG. 2.

Referring now in particular to both FIG. 2 and FIG. 3 is shown a modified aerating glass, identified in general by the reference numeral 50. The modified glass 50 is of the coffee cup or tea cup variety that is commonly used to consume a hot beverage.

The modified aerating glass 50 is shown to illustrate how the instant invention is readily adaptable for use with hot beverages (where it also has an additional unexpected benefit). It also illustrates how a modified internal conduit 52 can be formed integral with the glass 50 and how the glass 50 is adapted for either right or left handed usage.

A modified lower opening 54 is disposed near a bottom of the modified glass 50. The modified lower opening 54 is in communication with a modified upper opening 56 of the internal conduit 52.

Two possible locations for a modified infusion opening 58*a*, 58*b* are shown, one being on the inside (58*a*, FIG. 3) of the modified glass 50 and the other being on the outside (58*b*, FIG. 2) of the modified glass 50.

An inside portion 60 of the modified glass proximate the modified internal conduit 52 is enlarged, as desired, to accommodate the modified internal conduit 52. Looking down from the top (FIG. 3) only the upper opening 56, lower opening 54, and modified infusion opening (58*a*, 58*b*) are visible with the modified conduit 52 being formed integral with the material used to form the modified glass 50.

This makes the modified glass 50 appear much as a typical coffee cup, tea cup, or mug.

If the fluid is hot, the ambient air that enters in through the modified infusion opening 58*a*, 58*b* also helps cool the fluid before it enters into the mouth thereby allowing its consumption sooner than would occur without benefit of the modified aerating glass 50.

Also shown (FIG. 3) is a second modified conduit 70 that is constructed the same as the modified conduit 52, except that the second modified conduit 70 is disposed on a side of the modified glass 50 that is opposite that of the modified conduit 52.

If the user is right-handed, then the modified conduit 52 is normally used. If the user is left-handed, then the second modified conduit 70 is normally used.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An aerating glass, comprising:

(a) a container adapted to hold a quantity of a fluid;

(b) a conduit that includes an upper end and an opposite bottom end and wherein said bottom end includes a bottom opening that is in communication with an interior of said container, and wherein said conduit includes a hollow core that begins at said bottom opening, and wherein said hollow core extends along a longitudinal length of said shaft to said upper end and wherein said upper end includes an upper opening that is disposed above said bottom opening; and (c) an infusion opening through said conduit that is in communication with ambient air on one side thereof and with an interior of said hollow core on an opposite side thereof and wherein said infusion opening is disposed between said bottom end and said upper end of said conduit, and wherein said infusion opening is adapted to allow entry of ambient air into said fluid when said fluid is being drawn by partial vacuum through said conduit.

2. The aerating glass of claim 1 wherein said infusion opening includes an area that is smaller than the area of said bottom opening.

3. The aerating glass of claim 1 wherein at least a portion of said conduit is disposed on an exterior portion of said container.

4. The aerating glass of claim 1 wherein at least a portion of said conduit is disposed on an interior portion of said container.

5. The aerating glass of claim 1 wherein at least a portion of said conduit is contained within a sidewall of said container.

6. The aerating glass of claim 1 wherein said infusion opening includes a diameter that does not exceed one-sixteenth sixteenth of an inch.

7. The aerating glass of claim 1 including a second conduit that is disposed on an opposite side of said container, and wherein a bottom end of said second conduit is in contact with said fluid when a sufficient quantity of said fluid is disposed in said container and wherein an opposite upper end of said second conduit is disposed above a typical maximum level of said fluid.

8. The aerating glass of claim 1 wherein said bottom opening is adapted for placement into said fluid when a sufficient quantity of said fluid is disposed in said container.

9. The aerating glass of claim 8 wherein said upper opening is not adapted for placement into said fluid when said bottom opening is disposed in said fluid.

10. The aerating glass of claim 1 wherein said fluid includes a wine.

11. The aerating glass of claim 1 wherein said conduit is adapted for use in transporting said fluid into said bottom opening, through said hollow core of said conduit, and out of said upper opening when a partial vacuum is created at said upper opening.

12. The aerating glass of claim 11 wherein said infusion opening is adapted to permit a quantity of ambient air to enter into said hollow core and mix with a quantity of said fluid in said hollow core sufficient to produce a quantity of aerated fluid.

13. The aerating glass of claim 1 wherein said fluid includes a beverage.

14. The aerating glass of claim 13 wherein said beverage is at a temperature that is elevated above room temperature.

15. The aerating glass of claim 14 wherein said ambient air that is passing through said infusion opening and entering into said conduit is adapted to cool said beverage prior to an intake of said beverage into a mouth of a user.

16. The aerating glass of claim 1 wherein said container includes a stemware.

17. The aerating glass of claim 1 wherein said container includes a cup.

18. The aerating glass of claim 1 wherein said container includes a mug.

19. The aerating glass of claim 1 wherein said fluid includes a beverage that is at a temperature that is below room temperature.

20. The aerating glass of claim 1 wherein said infusion opening is disposed above a typical maximum fluid level in said container.

* * * * *